US010789819B1

(12) United States Patent
Tov et al.

(10) Patent No.: US 10,789,819 B1
(45) Date of Patent: Sep. 29, 2020

(54) SYSTEM AND METHOD FOR VOICE ANNOUNCEMENT OVER COMMUNICATION PATH IN SIREN SYSTEM

(71) Applicant: MOTOROLA SOLUTIONS, INC, Chicago, IL (US)

(72) Inventors: Jacob Shem Tov, Jerusalem (IL); Gonen Peleg Dahan, Buffalo Grove, IL (US); Ido Merkado, Tel Aviv-Yaffo (IL); Marc Brauer, Rolling Meadows, IL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 16/294,035

(22) Filed: Mar. 6, 2019

(51) Int. Cl.
*G08B 3/00* (2006.01)
*G08B 3/10* (2006.01)

(52) U.S. Cl.
CPC ..... *G08B 3/10* (2013.01)

(58) Field of Classification Search
CPC ..... G08B 3/10; H04R 3/12; H04R 27/00
USPC ..... 340/7.62
See application file for complete search history.

(56) References Cited

U.S. PATENT DOCUMENTS 5,121,430 A * 6/1992 Ganzer ..... G08B 27/008 348/E7.025
5,365,214 A * 11/1994 Angott ..... G08B 1/08 340/328
5,535,278 A * 7/1996 Cahn ..... G01S 19/24 380/274
8,107,625 B2 1/2012 Boland et al.
8,428,273 B2 * 4/2013 Nathan ..... H04R 5/04 340/311.2
2003/0120925 A1 6/2003 Rose et al.
2005/0135570 A1 * 6/2005 Binning ..... H04L 12/2803 379/45
2008/0001780 A1 * 1/2008 Ohno ..... G10L 17/26 340/904
2008/0309449 A1 * 12/2008 Martin ..... H04W 4/90 340/3.1
2009/0298451 A1 * 12/2009 Malaga ..... H04B 1/40 455/129
2010/0157913 A1 * 6/2010 Nagata ..... H04L 5/0039 370/329

(Continued)

FOREIGN PATENT DOCUMENTS

EP 1972157 A2 9/2008
GB 2249928 A * 5/1992 ..... H04H 60/04

*Primary Examiner* — Yong Hang Jiang

(57) ABSTRACT

Techniques for voice announcements over communications paths in siren systems are provided. In one aspect, a siren activation sequence including an audio identification sequence may be received at a siren alert site controller over a data communications channel of a first communications path. The audio identification sequence may be extracted from the siren activation sequence. A first combined audio signal may be received at the siren alert site controller over a voice communications channel of the first communication path. It may be determined that the first combined audio signal includes the audio identification sequence. The audio identification sequence may be extracted from the first combined audio signal to create a first audio signal. The first audio signal may be played over a siren controlled by the siren alert site controller.

18 Claims, 5 Drawing Sheets

(56) References Cited

U.S. PATENT DOCUMENTS

| | | | |
|---|---|---|---|
| 2018/0174591 | A1 | 6/2018 | Kurian et al. |
| 2018/0359249 | A1 | 12/2018 | Lian et al. |
| 2019/0013027 | A1 | 1/2019 | Page et al. |

* cited by examiner

SYSTEM AND METHOD FOR VOICE ANNOUNCEMENT OVER COMMUNICATION PATH IN SIREN SYSTEM

BACKGROUND

Emergency warning systems, such as siren alerting systems are a vital system used to keep the general public informed about threats to their safety. Sirens may be used to inform the public of approaching dangerous situations and in some cases may be used to indicate that the danger has passed. Dangerous situations may be naturally occurring, such as destructive weather (e.g. tornadoes). Dangerous situations may be man-made (e.g. nuclear or terrorist attacks). Regardless of the type of danger, siren systems may be used to provide information to the general public, over large distances. Siren systems have the advantage that because they effectively operate using a large speaker, there is no need for the public to use any type of electronic device (e.g. emergency weather radio, television/radio Emergency Alert System, etc.). As long as a person can hear and is within audible range of the siren, they can be alerted to the impending danger.

In the past, sirens may have been purely mechanical devices. For example, some siren designs produced a tone through use of a slotted, spinning, wheel. Such sirens may be used to provide a loud sound to alert the public, but are somewhat limited in the information that can be conveyed. More recently, sirens with capabilities to play more complex audio messages have been developed. Such systems are often referred to as Big Voice/Giant Voice systems. The audible messages may be pre-recorded voice messages or may include live voice messages provided by the siren system operator. For example, the voice messages may indicate what the pending danger is and may provide instructions on what actions the public should take (e.g. shelter in place, evacuate, etc.).

It should be noted that although siren systems have been described in the context of emergency warning systems, the systems may also be used for non-emergency purposes, and may convey audio other than voice. For example, on many military bases, sirens may be used to inform base personnel of daily activities (e.g. reveille, retreat, quiet hours) and may use the audio capabilities to play music relevant for those activities (e.g. bugle call, national anthem, taps).

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
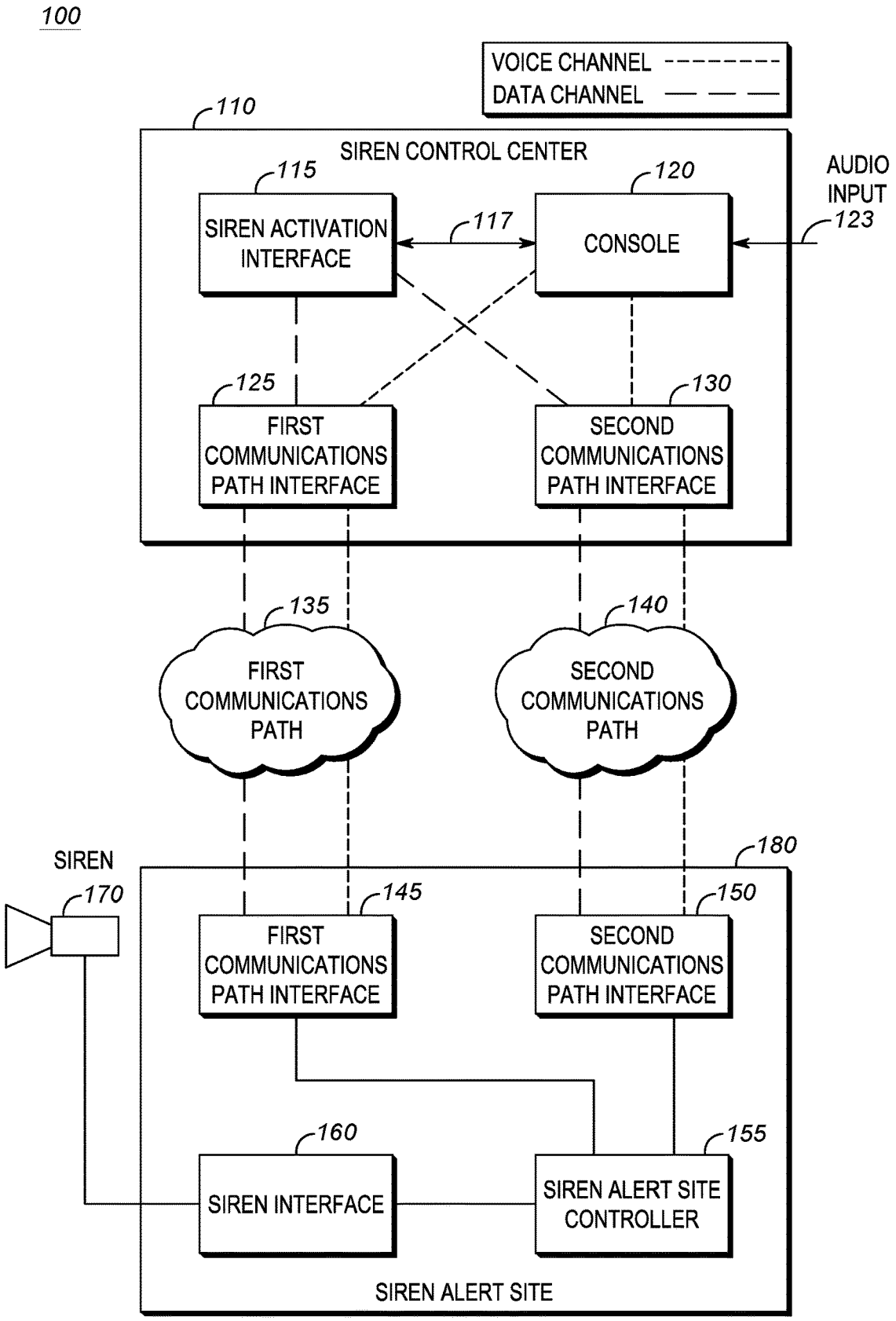
FIG. 1 is a block diagram of an example system that may implement the voice announcement over communication path in a siren system techniques described herein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Given the vital importance of siren alerting systems, such systems are often called Mission Critical (MC) systems. These systems must operate, to the extent possible, at all times, regardless of the conditions present. For example, in a severe weather situation power lines may be down and networks connecting siren alerting sites (i.e. sites that contain the siren alerting equipment) to siren control centers (i.e. control centers that may control the activation of one or more siren alerting sites) may be unavailable. Regardless of these challenges, the siren alerting system must still operate.

In order to ensure the continuous availability of MC siren systems, the systems are engineered to be able to withstand numerous faults. For example, to guard against power failure, both the siren control centers and siren alerting sites may be equipped with onsite backup power generation facilities. To guard against loss of communications between the siren control center and the siren alerting sites, the communications may be wireless. To further guard against loss of communications, more than one wireless communications path between the siren control center and siren alerting sites may be established, such that loss of one communications path does not render the siren alerting site unreachable.

In addition to the requirement that the siren alerting system is always available, there is also the need for the siren alerting system to remain secure. For example, it needs to be ensured that siren activations may only be performed by authorized personnel. In a recent incident in a major United States city, a malicious actor was able to cause the city's tornado warning siren to be activated multiple times overnight, despite the fact that there was no inclement weather. The false activation caused considerable unwarranted fear for the residents of the city. In order to prevent such occurrences, systems may be designed such that the activation sequence sent from the siren control center to the siren alerting sites are secure (e.g. encrypted) such that the siren alerting sites do not activate unless they are able to confirm the activation sequence was sent from an authorized siren control center.

The techniques described above may ensure that a siren can be activated, regardless of faults that may exist within the system. They may also ensure that only authorized users may activate the sirens. However, additional problems can arise in the context of sending audio (e.g. voice messages) from the siren control center to the siren alerting sites. For example, a siren alerting sequence may be sent to the siren alerting site over redundant communications paths. If both paths are operational, the siren will receive the activation sequence twice (once over each path). Because the activation sequence is typically a digital message, the siren alerting site can compare the activation sequences and determine that they are duplicates, rather than two separate activations. The duplicate activation sequence may then be discarded.

The same cannot be said of a voice message, whether sent using analog or digital techniques. As mentioned, different communications technologies may be used for each of the redundant communications paths. Due to differences in the communications technologies (e.g. different vocoders, different compression, different available bandwidth) the voice messages received over the redundant communications paths may not appear to be identical, or at least not sufficiently identical, such that one of the voice messages can be discarded with a high level of confidence.

In order to overcome this problem, the voice message may not be sent over both communications paths. However, this introduces the new problem that the system operator must select which one of the communications paths to use. If the chosen path happens to be unavailable (e.g. damaged in a weather incident) the voice message may never reach the siren alerting site.

In addition, in many siren implementations, the activation sequence is sent over a data channel of the communications path while the voice is sent over a voice channel. The data channel may be encoded such that the siren alerting site can be assured that activation sequence originated from an authorized siren control center. However, the voice communications path may offer no such assurances.

Furthermore, current techniques may not provide the ability to correlate a given siren activation sequence with a given voice message. For example, consider a siren that has been activated to signal an all clear condition. A siren activation sequence may be sent to turn on the siren with a voice message of "All Clear." However, due to the use of multiple communications paths, the voice message may be delayed. In the intervening time, a new siren activation sequence may be sent to activate the siren for a new threat (e.g. another tornado approaching). This may cause the siren to activate, but then play the late arriving "All Clear" voice message, when in fact, all is not clear.

Finally, in many implementations, unlike the path over which the siren activation sequence is sent, there may be no additional coding for the voice communications path. For example, in one commonly used communications path, Project 25 (P25) Land Mobile Radio (LMR), the voice path may simply be a considering the siren as a participant within a talkgroup. Any person who is able to gain floor control of the talkgroup (either through malicious action or inadvertent misconfiguration) would be able to broadcast their communications over the talkgroup through the siren. The siren would have no way of knowing if the voice message originated from an authorized user at the siren control center or if the voice message is an unauthorized voice message.

The techniques described herein overcome these problems and others. At the time a siren activation sequence is generated, an audio identification sequence that is associated with the specific siren activation sequence is generated. The audio identification sequence may be included in the siren activation sequence and sent to the siren over the available communications paths. The audio identification sequence may then be combined with an audio message to be played by the siren. The combination may be in a manner such that if the recipient knows the audio identification sequence, the original audio message can be extracted from the combined audio message. The combined audio message may then be sent to the siren alerting site over any available voice communications paths.

At the siren alerting site, a siren activation sequence may be received in order to activate the siren. The audio identification sequence may be extracted from the siren activation sequence. Upon receipt of a voice message, the siren activation site may determine if the received audio message includes the audio identification sequence. If so, the siren alerting site can be ensured that the source of the voice message is the same as the source of the siren activation sequence, and thus is authentic. Furthermore, the siren alerting site is able to confirm that a particular audio message is associated with a given siren activation sequence.

Finally, the siren alerting site may keep track of received audio identification sequences. If the same sequence has been previously received, this may be an indication that the audio message being received is a duplicate of a previously received audio message. In some cases, the audio message may be discarded. In other cases, the duplicate audio message may be combined with the previously received audio message to improve the sound quality of the audio played by the siren.

A more detailed description of the voice announcement over communications path in siren system can be found below and in conjunction with the appended figures.

A system that comprises a processor and a non-transitory processor readable medium containing thereon a set of instructions is provided. The instructions when executed by the processor cause the processor to receive an audio signal. The instructions cause the processor to generate an audio identification sequence. The instructions cause the processor to combine the audio identification sequence with the audio signal to create a combined audio signal. The instructions cause the processor to send the combined audio signal to a siren alerting site controller over a first voice channel associated with a first communications path. The instructions cause the processor to generate an activation sequence, the activation sequence including a representation of the audio identification sequence, the activation sequence being used to activate a siren. The instructions cause the processor to send the activation sequence to the siren alerting site controller over a first data channel associated with the first communications path.

In one aspect, the instructions cause the processor to send the combined audio signal to the siren alerting site controller over a second voice channel associated with a second communications path. The instructions cause the processor to send the activation sequence to the siren alerting site controller over a second data channel associated with the second communications path.

In one aspect the activation sequence is encrypted. In one aspect the audio signal is a live audio signal received from a microphone. In one aspect the audio signal is correlated with the activation sequence, wherein the correlation associates the audio signal with a specific activation sequence. In one aspect the first communications path is a Project 25 (P25) Land Mobile Radio (LMR) communications path and the second communications path is a Long Term Evolution (LTE) communications path.

A method is provided. The method includes receiving, at a siren alert site controller, over a data communications channel of a first communication path, a siren activation sequence, the siren activation sequence including an audio identification sequence. The method includes extracting the audio identification sequence from the siren activation sequence. The method includes receiving, at the siren alert site controller, over a voice communications channel of the first communication path, a first combined audio signal. The method includes determining the first combined audio signal includes the audio identification sequence, wherein the first combined audio signal is authenticated when it is determined the first combined audio signal includes the audio identification sequence. The method includes extracting the audio identification sequence from the first combined audio signal to create a first audio signal when the first combined audio signal includes the audio identification sequence. The method includes playing the first audio signal over a siren controlled by the siren alert site controller when the first combined audio signal includes the audio identification sequence.

In one aspect the method includes discarding the first combined audio signal when it is determined the first combined audio signal does not include the audio identification sequence. In one aspect the method includes receiving, at the siren alert site controller, over a voice communications channel of a second communication path, a second combined audio signal. The method includes determining the second combined audio signal includes the audio identification sequence. The method includes discarding the second combined audio signal as a duplicate of the first combined audio signal when it is determined the second combined audio signal includes the audio identification sequence.

In one aspect the first communications path is a Project 25 (P25) Land Mobile Radio (LMR) communications path and the second communications path is a Long Term Evolution (LTE) communications path. In one aspect the siren activation sequence is encrypted. In one aspect the first combined audio signal is the combination of the audio identification sequence and a live audio signal received from a microphone.

In one aspect the method includes receiving, at the siren alert site controller, over a voice communications channel of a second communication path, a second combined audio signal. The method includes determining the second combined audio signal does not include the audio identification sequence. The method includes discarding the second combined audio signal when it is determined the second combined audio signal does not include the audio identification sequence.

A system that comprises a processor and a non-transitory processor readable medium containing thereon a set of instructions is provided. The instructions when executed by the processor cause the processor to receive, at a siren alert site controller, over a data communications channel of a first communication path, a siren activation sequence, the siren activation sequence including an audio identification sequence. The instructions cause the processor to extract the audio identification sequence from the siren activation sequence. The instructions cause the processor to receive, at the siren alert site controller, over a voice communications channel of the first communication path, a first combined audio signal. The instructions cause the processor to determine the first combined audio signal includes the audio identification sequence, wherein the first combined audio signal is authenticated when it is determined the first combined audio signal includes the audio identification sequence. The instructions cause the processor to extract the audio identification sequence from the first combined audio signal to create a first audio signal when the first combined audio signal includes the audio identification sequence. The instructions cause the processor to play the first audio signal over a siren controlled by the siren alert site controller when the first combined audio signal includes the audio identification sequence.

In one aspect the instructions cause the processor to discard the first combined audio signal when it is determined the first combined audio signal does not include the audio identification sequence. In one aspect the instructions cause the processor to receive, at the siren alert site controller, over a voice communications channel of a second communication path, a second combined audio signal. The instructions cause the processor to determine the second combined audio signal includes the audio identification sequence. The instructions cause the processor to discard the second combined audio signal as a duplicate of the first combined audio signal when it is determined the second combined audio signal includes the audio identification sequence.

In one aspect the first communications path is a Project 25 (P25) Land Mobile Radio (LMR) communications path and the second communications path is a Long Term Evolution (LTE) communications path. In one aspect the siren activation sequence is encrypted. In one aspect the first combined audio signal is the combination of the audio identification sequence and a live audio signal received from a microphone.

In one aspect the instructions cause the processor to receive, at the siren alert site controller, over a voice communications channel of a second communication path, a second combined audio signal. The instructions cause the processor to determine the second combined audio signal does not include the audio identification sequence. The instructions cause the processor to discard the second combined audio signal when it is determined the second combined audio signal does not include the audio identification sequence.

FIG. 1 is a block diagram of an example system that may implement the voice announcement over communication path in a siren system techniques described herein. System 100 may include a siren control center 110 and at least one siren alert site 180. Although only a single siren control center is shown, it should be understood that system 100 may include multiple centers from which the sirens may be activated. For example, a local law enforcement agency may maintain a siren control center in order to alert the public of public safety issues, while a different agency may maintain a siren control center to alert the public with respect to weather issues. Likewise, although only a single siren alert site is shown, a given geographic area may be covered by multiple siren alert sites to ensure complete audio coverage of the geographic area. System 100 may also include first and second communications paths 135, 140 that allow communicative coupling between siren control center 110 and siren alert site 180.

Siren control center may include siren activation interface 115. The siren activation interface may be used by the system operator in order to activate the sirens at the siren alert sites. As mentioned above, there may be multiple siren alert sites. Siren activation interface 115 may be used to select which siren alert sites are to be activated. Siren activation interface may generate a siren activation sequence, which may include commands that are sent to the siren alert sites. In addition, the siren activation interface may generate an audio identification sequence. The audio identification interface may be sent to a console 120 over link 117. Use of the audio identification sequence is described in further detail below.

System 100 may also include console 120. Console 120 may be used by the siren system operator to receive audio input 123 that is to be sent to the siren alert site. Audio input 123 may be live input, such as that which would come from a microphone or it may include recorded audio input. The audio input may be in an analog or digital form. What should be understood is that audio input 123 is the audio that the siren system operator wishes to be played over the siren.

Although siren activation interface 115 and console 120 have been described as separate elements, it should be understood that this is for purposes of ease of description. The functionality of siren activation interface 115 and console 120 can be merged into a single element or may alternatively be distributed to even more elements. What should be understood is that there are two functionalities provided. The first is the ability to activate a siren. The second is the ability to send an audio signal to that siren in order for the siren to play the audio signal.

Siren control center 110 may include first communications path interface 125. The first communications path interface may allow the siren control center to send information to the siren alert site over a first communications path 135. The techniques described herein are not limited to may particular type of communications path. The first communications path interface adapts the data to be sent to the siren alert site to the format needed by the communications path 135.

For example, one possible communications path may be the Project 25 (P25) Land Mobile Radio (LMR) network. As such, the first communications path interface 125 may be an interface to convert the data sent by the siren control center to P25 network packets. Another example communications path may be a $4^{th}$ Generation Long Term Evolution (LTE) communications path. In that case, the first communications path interface may include an LTE modem capable of communicating with an LTE network. In yet another example, a communications path may be a direct radio link that does not utilize any type of intervening network. The first communications path interface may include a radio transceiver in order to communicate with the siren alert site over direct radio communications.

The communications path may include two logical channels. One channel may be a referred to as a voice channel. The voice channel may be used to send audio messages to the siren alert site. The other channel may be referred to as the data channel. The data channel may be used to send siren activation sequences that cause the siren alert site to activate the siren. It should be understood that although the channels are referred to as voice and data, this does not imply that one channel is analog and the other digital, but rather is simply used to distinguish between the channel that send the siren activation sequence and the channel that sends the audio signal. In many cases, both signals may actually travel over the same physical channel. For example, in an LTE system, everything, including analog voice, is transmitted as digital data packets.

Siren control center 110 may also include a second communications path interface 130 that is coupled to a second communications path 140. The second communications path interface and the second communications path share the same description as the first communications path interface 125 and the first communications path 135. Typically, in order to ensure maximum reliability, a system operator would choose two different technologies for the communications paths. For example, a system operator may choose a P25 communications path and a LTE communications path. If one of those technologies were to fail, the other may still be available, thus maximizing the chances that a siren activation could be sent to the siren alert site. Furthermore, it should be understood that although only two communications paths are shown, an actual implementation may have more than two communications paths for even greater reliability.

Siren alert site 180 may include first communications path interface 145 and second communications path interface 150 that allow the siren alert site to communicate with the siren control center 110 over first communications path 135 and second communications path 140. As explained above, the communications path interface is dependent on the technology used for the communications paths.

Siren alert site 180 may also include a siren alert site controller 155. The siren alert site controller may receive signals (e.g. siren activation sequence, audio signal) from the siren control center. As will be explained in more detail below, the siren alert site controller may receive a siren activation sequence from the siren control center over the data channels of the communications paths 135,140. The siren alert site controller may receive audio signals over the voice channels of the communications paths 135,140. The siren alert site controller may determine if the audio signal is authentic, and is not a duplicate, and if so may send the audio signal to the siren interface 160. Siren interface 160 may be coupled to a physical siren 170 that may produce the audible signal that is sent over the siren to the public.

In operation, a siren system operator may determine that a siren should be activated and that the siren activation shall include an audio message. The siren activation interface 115 may be used to generate the siren activation sequence. As part of that process, an audio identification sequence that is associated with this particular siren activation is generated. A representation of the audio identification sequence is included in the siren activation sequence. The siren activation sequence may be sent to the siren alert site controller over a data channel of the first and second communications paths 135, 140.

In addition to sending the siren activation sequence to the siren alert site, the siren activation interface may also send the audio identification sequence to the console 120 over link 117. The console may receive audio input 123 and combine the audio input with the audio identification sequence to create a combined audio signal. The particular combination technique is relatively unimportant. What should be understood is that any combination techniques that allow the original audio input to be recovered from the combined audio signal when the receiver knows the audio identification sequence.

For example, a simple combination may be to prepend the audio identification sequence to the audio input. A receiver that knows the audio identification sequence can simply remove that sequence from the beginning of the combined audio signal to recover the original audio input. Other, more complex techniques may also be used. For example, the audio identification sequence may be used as a key to scramble the audio input. The scrambling process may be one such that knowledge of the audio identification sequence would allow the original audio input to be recovered from the combined audio. The console 120 may then send the combined audio signal to the siren alert site over the first and second communications paths 135, 140.

The siren activation sequence may be received by the siren alert site controller from the first and second communications paths 135, 140 over the data channels of those paths through first and second communications path interfaces 145, 150. The siren alert site controller may extract the audio identification sequence from the siren activation sequence. The siren alert site controller may also receive the combined audio signal from the first and second communications paths 135, 140 over the voice channels of those paths through first and second communications path interfaces 145, 150.

The siren alert site controller may then use the extracted audio identification sequence to determine if the combined audio signal is authentic and is associated with the received siren activation sequence. Depending on the results of the determination, the siren alert site controller may recover the original audio input from the combined audio signal and cause it to play over the siren 170 by utilizing the siren interface or the siren alert site controller may discard the combined audio signal. Such operation is described in further detail below.

Figure 2:
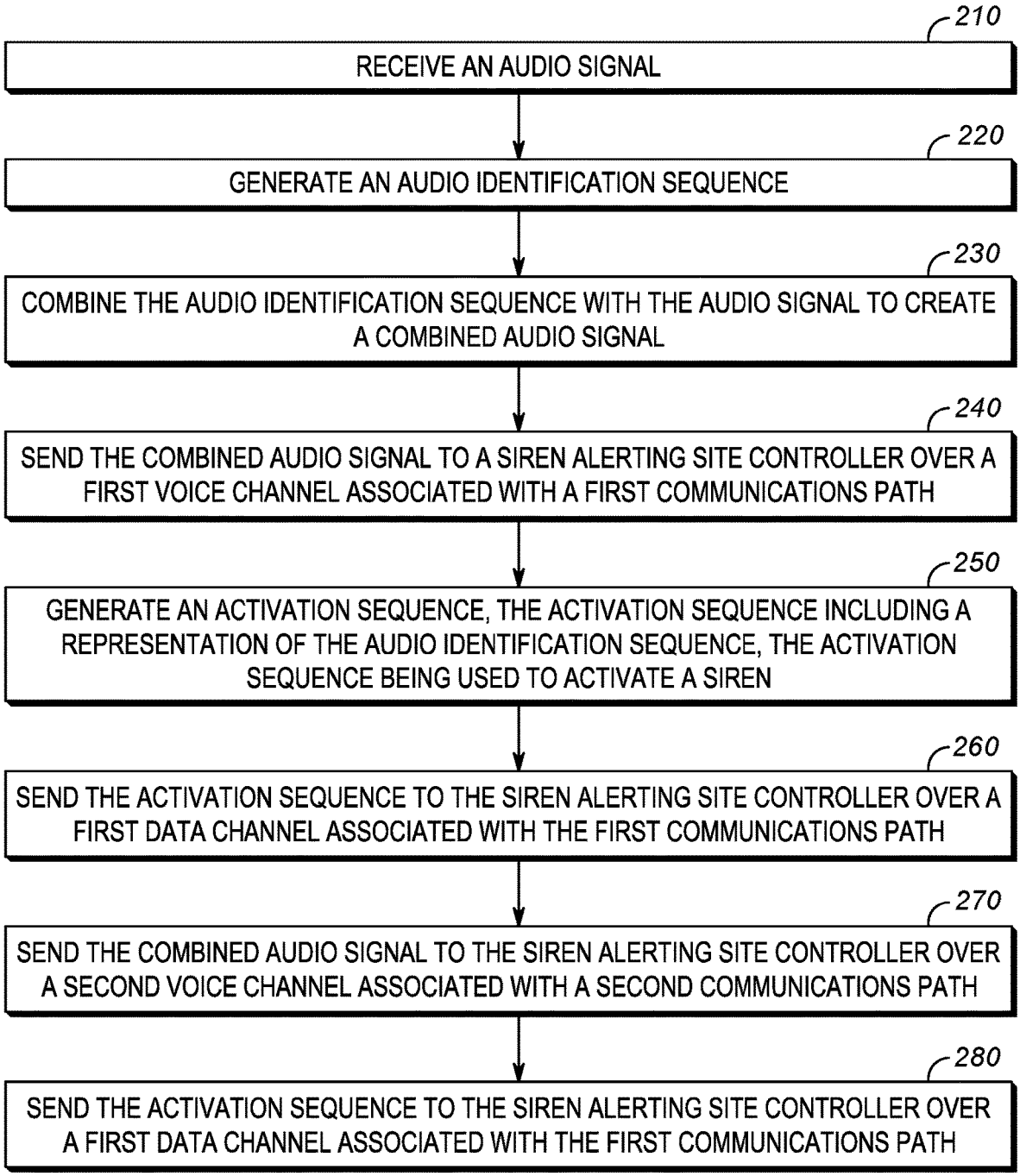
FIG. 2 is an example of a flow diagram for a siren control center that may implement the voice announcement over communication path in a siren system techniques described herein.

FIG. 2 is an example of a flow diagram for a siren control center that may implement the voice announcement over communication path in a siren system techniques described herein. In block 210, an audio signal may be received. The audio signal may be an audio signal that the siren system operator wishes to have transmitted via the siren. As mentioned above, the techniques described herein are not limited to any particular type of audio signal. The audio signal may be spoken human voice, music, or any combination thereof.

Furthermore, the techniques described herein are not limited to any particular source of audio. For example, the audio signal may be a real time voice or music signal as captured via a microphone. In other cases, the audio signal may be a recorded audio signal. The audio signal may have been previously recorded and stored. The audio signal may have been stored in any format, including analog or digital. In some cases, the audio signal may be generated from a text to speech conversion.

In block 220, an audio identification sequence may be generated. The audio identification sequence may be any audio sequence that may be combined with the received audio signal. For example, a rudimentary audio identification sequence may be a single frequency tone. Other example audio identification sequences may include a mixture of several frequencies. Yet other examples may include varying tones. In some cases, the audio identification sequence may be an audio signal such as voice or music. The techniques herein are not limited to any particular type of audio identification sequence. What should be understood is that the siren control center generates the audio identification sequence and as such may be the only entity in possession of the sequence.

In block 230, the audio identification sequence may be combined with the audio signal to create a combined audio signal. The techniques described herein are not limited to any particular type of combination. In one example implementation, the audio identification sequence may be prepended to the audio signal. In other example implementations, the audio identifications sequence may be added to the end of the audio signal. In yet other example implementations the audio identification sequence may be inserted into the middle of the audio signal.

In yet other example implementations, the audio signal and the audio identification sequence may be combined through mixing the signals. In yet another example implementation, the combination may utilize the audio identification sequence as an input to a scrambling process that is applied to the audio signal. What should be understood is that any technique to combine the audio signal and the audio identification sequence may be used, so long as that technique allows the audio signal to be extracted from the combined audio signal when the receiver is aware of the audio identification sequence.

In block 240, the combined audio signal may be sent to a siren alerting site controller over a first voice channel associated with a first communications path. As mentioned above, the siren control center may have more than one communications path to use when communicating with the siren alerting site. Each communications path may be an analog path, a digital communications path, or a combination thereof. For example, an LMR radio may be capable of both analog or digital communications. Each communications path may have separate channels for audio vs digital data. For example, audio data may be sent using an analog encoding on a voice channel while digital data is sent using a digital encoding on a data channel. In other cases, audio data may first be converted, using an analog to digital converter, and then sent as if it were data.

The techniques described herein are not dependent on any particular mechanism used for transmitting the audio data. What should be understood is that a voice channel and a data channel may be logical constructs on a communications path. It is not intended to imply any particular type of encoding (e.g. analog vs digital, etc.) but rather to indicate that the siren controller may segregate information to be sent to the siren alerting site, with audio signals sent over a different logical communications channel than other signals, such as siren activation sequences.

In block 250, an activation sequence may be generated. The activation sequence may include a representation of the audio identification sequence. The activation sequence may be used to activate a siren. The representation of the audio identification sequence may be dependent of the particular type of audio identification sequence being used, as well as the particular technology that will be used to send the activation sequence.

For example, in the case where the audio identification sequence is a simple, single frequency tone, specification of the frequency may be sufficient. Likewise, in the case where the audio identification sequence is a combination of multiple frequencies, the representation may be a list of frequencies that were combined. In cases where the audio identification sequence is more complex (e.g. a musical song), an analog to digital conversion of the audio identification sequence may be performed.

The techniques described herein are not limited to any particular type of representation of the audio identification sequence. What should be understood is that sufficient information is included in the activation sequence to allow the siren alerting site to recreate the audio identification sequence. As will be explained in further detail with respect to FIG. 3, the siren alerting site may use the recreated audio identification sequence to extract the audio signal from the combined audio signal.

In block 260, the activation sequence may be sent to the siren alerting site controller over a first data channel associated with the first communications path. As mentioned above, each communications path may have separate logical voice and data channels, even if, in fact, there is only a single physical channel. Siren activation sequences typically consist of data, and as such are sent over the data channel of a communications path.

Although not required, in some implementations, the siren activation sequence is encrypted prior to sending in such a way that when decrypted by the siren alerting site controller, the controller can be assured of the authenticity of the message. For example, one common way such encryption might be implemented is through the use of public-private key encryption. The siren control center may encrypt the activation sequence using a private key known only to the siren control center. Each siren alerting site may be in possession of the public key associated with the private key. If the siren alerting site is able to decrypt the message, it can be assured the activation sequence originated from the siren control center.

In addition, because the representation of the audio identification sequence is included in the siren activation sequence, the audio identification sequence itself may be protected from being observed by any entity that is not in possession of the proper information for decryption. Furthermore, just as the encryption mechanisms above assures the siren alerting site controller that the siren activation sequence is authentic, it also ensures that the representation of the audio identification sequence is authentic.

In block 270, the combined audio signal may be sent to the siren alerting site controller over a second voice channel associated with a second communications path. As mentioned above, siren alerting systems are considered mission critical systems. By using redundant communications paths, in particular redundant communications paths utilizing different technologies, the risk of a single point of failure of the communications path is reduced.

In block 280, the activation sequence may be sent to the siren alerting site controller over a second data channel associated with the second communications path. Again, the utilization of two separate communications paths reduces the likelihood that a failure of a single communications path would prevent the siren from activating.

Figure 3:
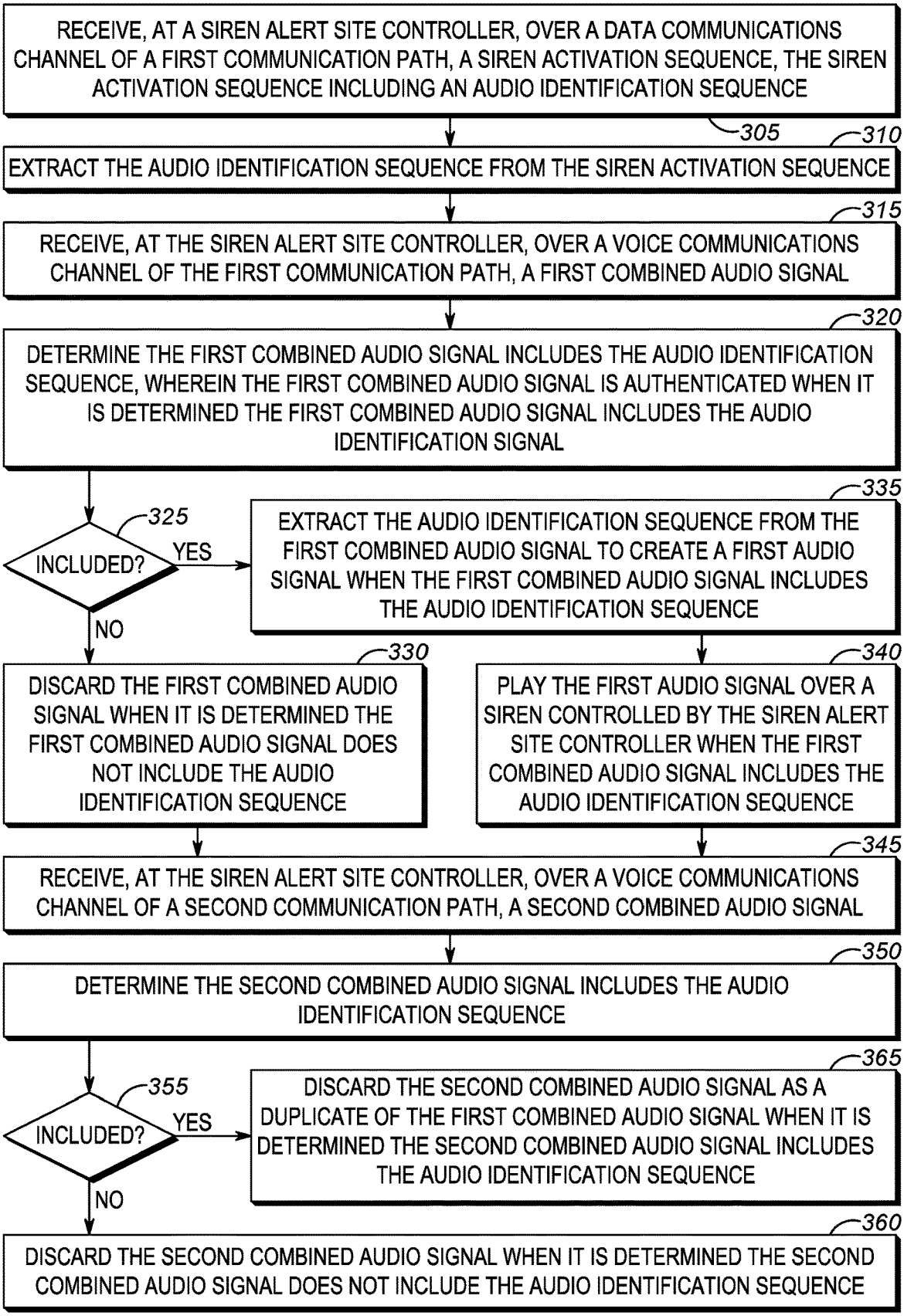
FIG. 3 is an example of a flow diagram for a siren alerting site that may implement the voice announcement over communication path in a siren system techniques described herein.

FIG. 3 is an example of a flow diagram for a siren alerting site that may implement the voice announcement over communication path in a siren system techniques described herein. In block 305, a siren activation sequence may be received, at a siren alert site controller, over a data communications channel of a first communications path. The siren activation sequence may include an audio identification sequence. As explained above, the siren activation sequence may be sent by the siren control center to the siren alerting site in order to command the siren alerting site controller to activate the siren.

In block 310, the audio identification sequence may be extracted from the siren activation sequence. In some cases, the siren activation sequence may be encrypted, thus preventing any observation of the sequence by unauthorized entities. As explained above, a representation of the audio identification sequence is included in the siren activation sequence. That representation may be used to recreate the audio signal.

In block 315, a first combined audio signal may be received at the siren alert site controller. The combined audio signal may be received over a voice communications channel of the first communications path. The combined audio signal may have been generated at the siren control center by combining an audio signal (e.g. a voice message to be played over the siren) with an audio identification sequence.

In block 320, it may be determined if the first combined audio signal includes the audio identification sequence. The first combined audio signal is authenticated when it is determined that the first combined audio signal includes the audio identification sequence. The process for the determination is dependent on the process used by the siren control center when the combined audio signal was created. For example, if the combination process was to simply prepend the audio identification sequence to the beginning of the audio signal, detecting the presence of the audio identification sequence at the beginning of the combined audio signal would be used to determine if the combined audio signal includes the audio identification sequence.

The techniques described herein are not dependent on any particular method for combining the audio identification sequence and the audio signal. As mentioned above, any technique that allows the original audio signal to be recovered from the combined audio signal, as long as the receiver knows the audio identification sequence, would be usable with the techniques described herein. The combined audio signal is considered authentic, because the siren alert site controller can be ensured that the combined audio signal came from the siren control center that sent the siren activation sequence, because the siren activation sequence includes the audio identification sequence that was generated by the siren control center.

In block 325, the results of the determination are evaluated. If the combined audio signal does not include the audio identification sequence, the process moves to block 330. In block 330, the first combined audio signal may be discarded when it does not include the audio identification sequence. The first combined audio signal is discarded because the siren alert site controller is unable to authenticate the combined audio signal originated from the siren control center that sent the siren activation sequence.

If the combined audio signal does include the audio identification sequence, the process moves to block 335. In block 335, the audio identification sequence may be extracted from the first combined audio signal to create a first audio signal when the first combined audio signal includes the audio identification sequence. By extracting the audio identification sequence, the first audio signal becomes the audio signal that was received by the siren control center in block 210.

In block 340, the first audio signal may be played over a siren controlled by the siren alert site controller when the first combined audio signal includes the audio identification sequence. In other words, the siren activation site controller has received a siren activation as well as an authenticated audio signal that is associated with that siren activation. The siren alert site controller can then cause the siren to play that authenticated audio signal.

In block 345, a second combined audio signal may be received at the siren alert site controller over a voice communications channel of a second communication path. As explained above, redundant communications paths may be used to ensure system reliability.

In block 350, it may be determined that the second combined audio signal includes the audio identification sequence. Block 350 is very similar to block 320. In other words, the siren activation site controller is attempting to authenticate the combined audio signal sent over the second path.

In block 355, the results of the determination are evaluated. If the audio identification sequence is not included in the second combined audio signal, this means the second combined audio signal could not be authenticated. The process moves to block 360. In block 360, the second combined audio signal may be discarded when it is determined the second combined audio signal does not include the audio identification sequence. In other words, the second combined audio signal cannot be authenticated as having originated from the siren control center that sent the siren activation sequence. As such, the second combined audio signal may be discarded.

In block 365, the second combined audio signal may be discarded as a duplicate of the first combined audio signal when it is determined the second combined audio signal includes the audio identification sequence. As described above, the combined audio signal may be sent over two communications paths, each of which may have different propagation delays. The combined audio signal may be received by the siren alert site controller multiple times. Thus, there is no reason to play both audio signals, and the later received combined audio signal can be discarded as simply being a duplicate of the previously received combined audio signal.

In some implementations (not shown) instead of discarding the duplicate message, the second combined audio signal may be used to improve the sound quality of the first audio signal. The audio identification sequence may be extracted from the second combined audio signal to create a second audio signal. The second audio signal may be combined with the first audio signal to improve the sound quality of the output to the siren.

Figure 4:
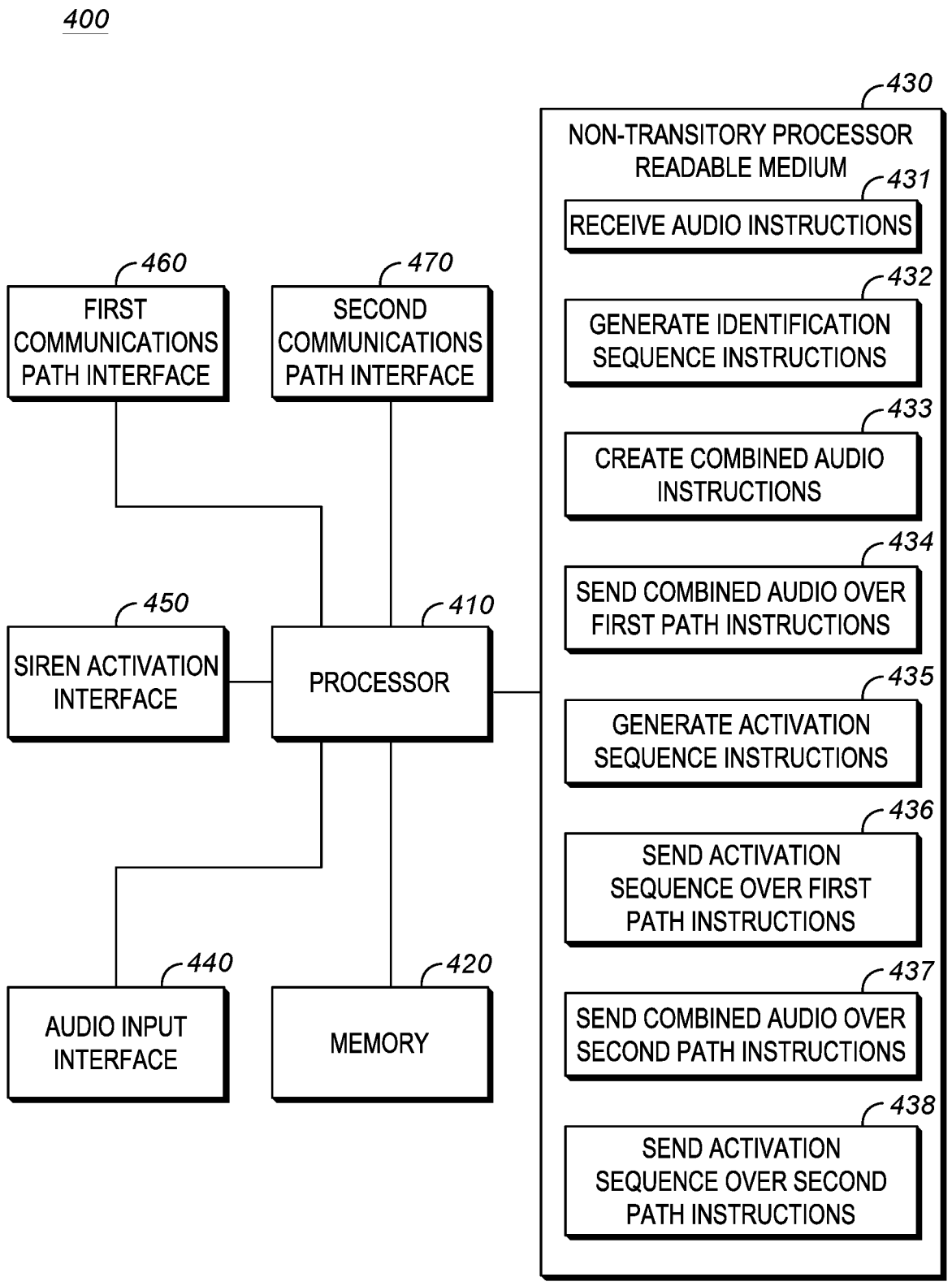
FIG. 4 is an example of a siren control center system that may implement the voice announcement over communication path in a siren system techniques described herein.

FIG. 4 is an example of a siren control center system that may implement the voice announcement over communication path in a siren system techniques described herein. It should be understood that FIG. 4 represents one example implementation of a system that utilizes the techniques described herein. Although only a single processor is shown, it would be readily understood that a person of skill in the art would recognize that distributed implementations are also possible. For example, the various pieces of functionality described above (e.g. audio identification sequence generation, combination, siren alert sequence inclusion, etc.) could be implemented on multiple devices that are communicatively coupled. FIG. 4 is not intended to imply that all the functionality described above must implemented on a single computer.

System 400 may include processor 410, memory 420, non-transitory processor readable medium 430, audio input interface 440, siren activation interface 450, first communications path interface 460, and second communications path interface 470.

Processor 410 may be coupled to memory 420. Memory 420 may store a set of instructions that when executed by processor 410 cause processor 410 to implement the techniques described herein. Processor 410 may cause memory 420 to load a set of processor executable instructions from non-transitory processor readable medium 430. Non-transitory processor readable medium 430 may contain a set of instructions thereon that when executed by processor 410 cause the processor to implement the various techniques described herein.

For example, medium 430 may include receive audio instructions 431. Receive audio instruction may cause the processor to receive an audio signal that is to be sent to a siren alerting site. For example, the audio single may be received through audio input interface 440. As explained above, the techniques described herein are not limited to any particular type of audio input interface. For example, the audio input may come from a microphone, an analog or digital recording, or any other source of audio. What should be understood is that audio input interface 440 may be used to receive an audio signal. Receive audio instructions 431 generally correspond with block 220.

Medium 430 may also include generate identification sequence instructions 432 which may be used by the processor to generate an audio identification sequence. Generate identification sequence instructions 432 may generally correspond with block 220. Medium 430 may also include create combined audio instructions 433. Create combined audio instructions 433 may cause the processor to combine the generated identification sequence with the received audio. As mentioned above, the techniques described herein are usable with any combination technique that allows recovery of the original audio signal by a receiver in possession of the identification sequence. Create combined audio instructions 433 may generally correspond with block 230.

Medium 430 may also include send combined audio over first path instructions 434. For example, the instructions may cause the processor to send the combined audio to the siren alert site controller using the first communications path interface 460. As described above, the techniques described herein are not limited to any particular type of communications system. First communications path interface 460 may be an interface to any system (wired or wireless) that allows the siren control center to be communicatively coupled with the siren alert site controller. Instructions 434 may generally correspond with block 240.

Medium 430 may also include generate activation sequence instructions 435. The generate activation sequence instructions may allow the processor to generate an activation sequence to be sent to the siren alert site controller, in order to activate the siren. The generate activation sequence instructions may cause the processor to include a representation of the audio identification sequence in the activation sequence. The generate activation sequence instructions 435 may generally correspond with block 250.

Medium 430 may also include send activation sequence over first communications path instructions 436. Send activation sequence over first communications path instructions 436 may cause the processor to send the activation sequence to the siren alert site controller using the first communications path interface 460. The send activation sequence over first communications path instructions 436 may generally correspond with block 260.

Medium 430 may also include send combined audio over second path instructions 437. Just as with instructions 434, instructions 437 may cause the processor to utilize second communications path interface 470 to send the combined audio signal to the siren alert site controller. As explained above, the second communications path may be different than the first communications path. Medium 430 may also include send activation sequence over second path instructions 438. Just as with instructions 436, instructions 438 may cause the processor to utilize second communications path interface 470 to send the activation sequence to the siren alert site controller. Instructions 437 and 438 may generally correspond with blocks 270 and 280 respectively.

System 400 may also include siren activation interface 450. Siren activation interface 450 may be used by the operator of the system to indicate that a condition exists (e.g. approaching tornado, terrorist attack, etc.) that requires siren alerting to be performed. Siren activation interface may be a human interface, which allows an operator to manually initiate siren activation. Siren activation interface 450 may be a programmatic interface that allows another system (e.g. national weather alert system) to initiate siren alerting. The techniques described herein are not dependent on any particular source for siren activation.

Figure 5:
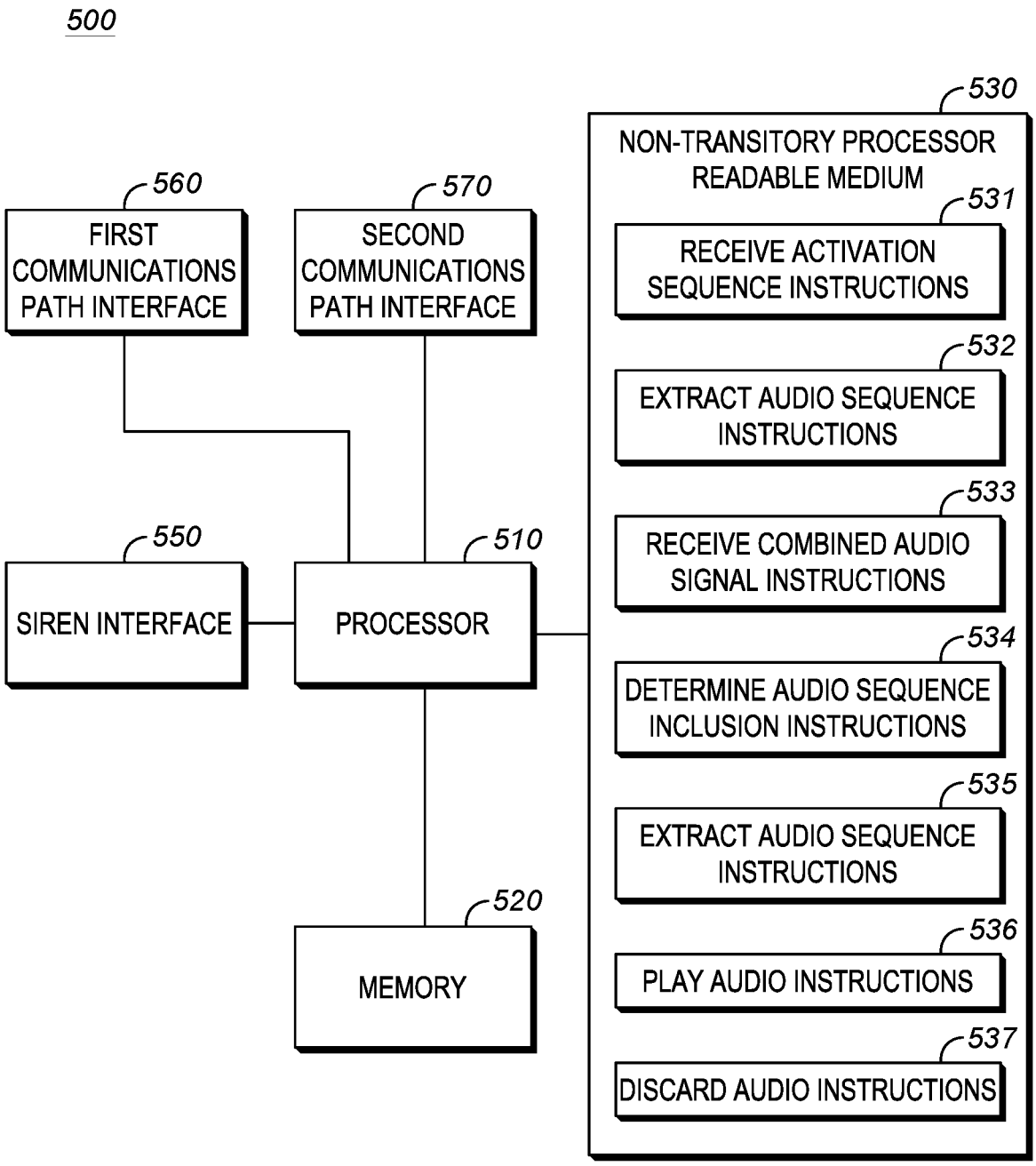
FIG. 5 is an example of a siren alerting site system that may implement the voice announcement over communication path in a siren system techniques described herein.

FIG. 5 is an example of a siren alerting site system that may implement the voice announcement over communication path in a siren alert system techniques described herein. It should be understood that FIG. 5 represents one example implementation of a system that utilizes the techniques described herein. Although only a single processor is shown, it would be readily understood that a person of skill in the art would recognize that distributed implementations are also possible. For example, the various pieces of functionality described above (e.g. audio identification sequence identification, extraction, etc.) could be implemented on multiple devices that are communicatively coupled. FIG. 5 is not intended to imply that all the functionality described above must implemented on a single computer.

System 500 may include processor 510, memory 520, non-transitory processor readable medium 530, siren interface 550, first communications path interface 560, and second communications path interface 570.

Processor 510 may be coupled to memory 520. Memory 520 may store a set of instructions that when executed by processor 510 cause processor 510 to implement the techniques described herein. Processor 510 may cause memory 520 to load a set of processor executable instructions from non-transitory processor readable medium 530. Non-transitory processor readable medium 530 may contain a set of instructions thereon that when executed by processor 510 cause the processor to implement the various techniques described herein.

For example, medium 530 may include receive activation sequence instructions 531. Instruction 531 may cause the processor to receive a siren activation sequence using the first communications path interface 560. Just as the siren control center may be connected to multiple communications paths, the siren alert site controller may also be connected to multiple communications paths. The instructions 531 may also cause the processor to receive the activation sequence over a second communications path interface 570. The receive activation sequence instructions 531 may generally correspond with blocks 305, 345.

Medium 530 may also include extract audio sequence instructions 532 that may be used by the processor 510 to extract the audio identification sequence from the combined audio signal. Thus, the processor is able to extract the representation of the audio identification sequence that was used when the siren control center combined an audio signal with the audio identification sequence. Instructions 532 may generally correspond with block 310. Medium 530 may also include receive combined audio signal instructions 533. The combined audio may be received over the first and/or second communications path by using the first and second communications path interface 560,570. Receiving the combined audio may generally correspond with blocks 315, 345.

The medium 530 may also include determine audio sequence inclusion instructions 534 which may allow the processor to determine if the audio identification sequence is included in the combined audio signal, and if so, allows the processor to confirm the combined audio signal is authentic. The determining audio sequence inclusion instructions 534 may generally correspond with blocks 320,350. The medium 530 may also include extract audio sequence instructions 535 to allow the processor to recover the original audio signal. Instructions 535 generally correspond to block 335.

The medium may also include play audio instructions 536 that may be used by the processor 510 to cause the siren to play the audio signal that was sent from the siren control center. For example, siren interface 550 may be connected to a physical siren that is capable of outputting audio. The processor may play the receive audio signal by sending the audio signal, through the siren interface, to the physical siren. Play audio instructions 536 generally corresponds to block 340.

The medium 530 may also include discard audio instructions 537. As explained above, in some cases, the combined audio signal is discarded. For example, if the combined audio signal does not include the audio identification sequence, or if the audio identification sequence has already been received, indicating that the received combined audio signal is a duplicate of a previously received combined audio signal. The discard audio instructions 537 generally correspond to blocks 330, 360, 365.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a compact disc read only memory (CD-ROM), an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and integrated circuits (IC) with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A system comprising:

a processor; and a non-transitory processor readable medium containing thereon a set of instructions that when executed by the processor cause the processor to:

receive an audio signal;

generate an audio identification sequence;

combine the audio identification sequence with the audio signal to create a combined audio signal;

send the combined audio signal to a siren alerting site controller over a first voice channel associated with a first communications path;

generate an activation sequence, the activation sequence including a representation of the audio identification sequence, the activation sequence being used to activate a siren, wherein the audio signal is correlated with the activation sequence, wherein the correlation associates the audio signal with a specific activation sequence; and send the activation sequence to the siren alerting site controller over a first data channel associated with the first communications path.

2. The system of claim 1 further comprising instructions that cause the processor to:

send the combined audio signal to the siren alerting site controller over a second voice channel associated with a second communications path; and send the activation sequence to the siren alerting site controller over a second data channel associated with the second communications path.

3. The system of claim 2 wherein the first communications path is a Project 25 (P25) Land Mobile Radio (LMR) communications path and the second communications path is a Long Term Evolution (LTE) communications path.

4. The system of claim 1 wherein the audio signal is a live audio signal received from a microphone.

5. The system of claim 1 wherein the activation sequence is encrypted.

6. A method comprising:

receiving, at a siren alert site controller, over a data communications channel of a first communication path, a siren activation sequence, the siren activation sequence including an audio identification sequence;

extracting the audio identification sequence from the siren activation sequence;

receiving, at the siren alert site controller, over a voice communications channel of the first communication path, a first combined audio signal;

determining the first combined audio signal includes the audio identification sequence, wherein the first combined audio signal is authenticated when it is determined the first combined audio signal includes the audio identification sequence;

extracting the audio identification sequence from the first combined audio signal to create a first audio signal when the first combined audio signal includes the audio identification sequence; and playing the first audio signal over a siren controlled by the siren alert site controller when the first combined audio signal includes the audio identification sequence.

7. The method of claim 6 further comprising:

discarding the first combined audio signal when it is determined the first combined audio signal does not include the audio identification sequence.

8. The method of claim 6 further comprising:

receiving, at the siren alert site controller, over a voice communications channel of a second communication path, a second combined audio signal;

determining the second combined audio signal includes the audio identification sequence; and discarding the second combined audio signal as a duplicate of the first combined audio signal when it is determined the second combined audio signal includes the audio identification sequence.

9. The method of claim 8 wherein the first communications path is a Project 25 (P25) Land Mobile Radio (LMR) communications path and the second communications path is a Long Term Evolution (LTE) communications path.

10. The method of claim 6 wherein the siren activation sequence is encrypted.

11. The method of claim 6 further comprising:

receiving, at the siren alert site controller, over a voice communications channel of a second communication path, a second combined audio signal;

determining the second combined audio signal does not include the audio identification sequence; and discarding the second combined audio signal when it is determined the second combined audio signal does not include the audio identification sequence.

12. The method of claim 6 wherein the first combined audio signal is the combination of the audio identification sequence and a live audio signal received from a microphone.

13. A system comprising:

a processor; and a non-transitory processor readable medium containing thereon a set of instructions that when executed by the processor cause the processor to:

receive, at a siren alert site controller, over a data communications channel of a first communication path, a siren activation sequence, the siren activation sequence including an audio identification sequence;

extract the audio identification sequence from the siren activation sequence;

receive, at the siren alert site controller, over a voice communications channel of the first communication path, a first combined audio signal;

determine the first combined audio signal includes the audio identification sequence, wherein the first combined audio signal is authenticated when it is determined the first combined audio signal includes the audio identification sequence;

extract the audio identification sequence from the first combined audio signal to create a first audio signal when the first combined audio signal includes the audio identification sequence;

play the first audio signal over a siren controlled by the siren alert site controller when the first combined audio signal includes the audio identification sequence;

receive, at the siren alert site controller, over a voice communications channel of a second communication path, a second combined audio signal;

determine the second combined audio signal includes the audio identification sequence; and discard the second combined audio signal as a duplicate of the first combined audio signal when it is determined the second combined audio signal includes the audio identification sequence.

14. The medium of claim 13 further comprising instructions to:

discard the first combined audio signal when it is determined the first combined audio signal does not include the audio identification sequence.

15. The medium of claim 13 wherein the first communications path is a Project 25 (P25) Land Mobile Radio (LMR) communications path and the second communications path is a Long Term Evolution (LTE) communications path.

16. The medium of claim 13 wherein the siren activation sequence is encrypted.

17. The medium of claim 13 further comprising instructions to:

receive, at the siren alert site controller, over a voice communications channel of a second communication path, a second combined audio signal;

determine the second combined audio signal does not include the audio identification sequence; and discard the second combined audio signal when it is determined the second combined audio signal does not include the audio identification sequence.

18. The medium of claim 13 wherein the first combined audio signal is the combination of the audio identification sequence and a live audio signal received from a microphone.

* * * * *